US010378527B2

(12) United States Patent
Kim

(10) Patent No.: US 10,378,527 B2
(45) Date of Patent: Aug. 13, 2019

(54) COMPRESSOR

(71) Applicant: Samsung Electronics Co., Ltd., Suwon-si (KR)

(72) Inventor: Jung Hyoun Kim, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 454 days.

(21) Appl. No.: 14/551,574

(22) Filed: Nov. 24, 2014

(65) Prior Publication Data

US 2015/0147203 A1 May 28, 2015

(30) Foreign Application Priority Data

Nov. 28, 2013 (KR) ..... 10-2013-0145965

(51) Int. Cl.
*F04B 39/02* (2006.01)
*F04B 39/00* (2006.01)
(Continued)

(52) U.S. Cl.
CPC ..... *F04B 39/0253* (2013.01); *F04B 39/0094* (2013.01); *F04B 39/0246* (2013.01);
(Continued)

(58) Field of Classification Search
CPC ..... F04B 39/0253; F04B 39/0094; F04B 39/0246; F04C 23/008; F04C 29/023; F04C 29/025; F04C 2240/60; Y10T 29/49242
(Continued)

(56) References Cited

U.S. PATENT DOCUMENTS 2,065,162 A * 12/1936 Trask ..... F25B 31/023 220/DIG. 12
3,563,677 A * 2/1971 Retan ..... F04B 39/0094 417/415
(Continued)

FOREIGN PATENT DOCUMENTS

CN 1455092 A 11/2003
CN 1455099 A 11/2003
(Continued)

OTHER PUBLICATIONS

Extended European Search Report dated Jun. 30, 2015 in European Patent Application No. 14195482.6.
(Continued)

*Primary Examiner* — Dominick L Plakkoottam
*Assistant Examiner* — Connor J Tremarche
(74) *Attorney, Agent, or Firm* — Staas & Halsey LLP

(57) ABSTRACT

A compressor may include a hermetic case to store oil in a lower portion thereof, a compression mechanism part to compress a refrigerant, a power train part to generate a driving force, a rotational shaft to transmit the driving force generated from the power train part to the compression mechanism part and including a hollow portion and a female screw part formed at the hollow portion, and an oil pumping member inserted into the hollow portion of the rotational shaft and including an oil pumping part which moves the oil stored in the lower portion of the hermetic case up and a male screw part which is coupled to the female screw part of the rotational shaft. Since the oil pumping member and the rotational shaft are firmly coupled to each other, the reliability of the oil supplying is improved.

14 Claims, 6 Drawing Sheets

(51) Int. Cl.
*F04C 23/00* (2006.01)
*F04C 29/02* (2006.01)

(52) U.S. Cl.
CPC ..... *F04B 39/0284* (2013.01); *F04C 23/008* (2013.01); *F04C 29/023* (2013.01); *F04C 29/025* (2013.01); *F04C 2240/60* (2013.01); *Y10T 29/49242* (2015.01)

(58) Field of Classification Search
USPC ..... 417/372, 386
See application file for complete search history.

(56) References Cited

U.S. PATENT DOCUMENTS

| | | | | |
|---|---|---|---|---|
| 4,456,437 | A * | 6/1984 | Kurahayashi | F04B 39/0246 184/6.16 |
| 2006/0013706 | A1* | 1/2006 | Ishida | F04B 39/0261 417/386 |
| 2012/0201699 | A1* | 8/2012 | Kim | F04B 39/0238 417/372 |
| 2013/0309119 | A1* | 11/2013 | Kim | F04B 39/0246 418/55.6 |

FOREIGN PATENT DOCUMENTS

| | | | |
|---|---|---|---|
| CN | 1701182 | A | 11/2005 |
| CN | 102900650 | A | 1/2013 |
| EP | 0728946 | A1 | 8/1996 |
| EP | 1605163 | | 12/2005 |
| EP | 2664795 | | 11/2013 |
| JP | 2000-314380 | | 11/2000 |
| KR | 2002-0088638 | | 11/2002 |
| KR | 2002-0088641 | | 11/2002 |

OTHER PUBLICATIONS

European Decision on Grant dated Apr. 5, 2016 in European Patent Application No. 14195482.6.
Chinese Office Action dated Sep. 29, 2017 in corresponding Chinese Patent Application No. 201410693477.2.
Chinese Office Action dated Apr. 16, 2018, in corresponding Chinese Patent Application No. 201410693477.2.
Chinese Office Action dated Nov. 6, 2018, in corresponding Chinese Patent Application No. 201410693477.2.
Chinese Office Action dated Apr. 19, 2019 in corresponding Chinese Patent Application No. 201410693477.2.

* cited by examiner

COMPRESSOR

CROSS-REFERENCE TO RELATED APPLICATIONS

This application claims the priority benefit of Korean Patent Application No. 10-2013-0145965, filed on Nov. 28, 2013 in the Korean Intellectual Property Office, the disclosure of which is incorporated herein by reference.

BACKGROUND

1. Field

Embodiments relate to an oil supplying mechanism of a hermetic reciprocating compressor in which a compression mechanism part compressing a refrigerant by reciprocation of a piston and a power train part generating a driving force are integrally formed and received in a hermetic case.

2. Description of the Related Art

Generally, a compressor is a device which is one of the construction elements of a cooling cycle apparatus and serves to compress a refrigerant at a high temperature and a high pressure. The compressor may be classified into various kinds according to its compression type and hermetic structure. Among them, a hermetic reciprocating compressor includes a compression mechanism part compressing a refrigerant by reciprocation of a piston, and a power train part driving the compression mechanism part. The compression mechanism part and the power train part are installed in one hermetic case.

The hermetic reciprocating compressor includes a rotational shaft which transmits a driving force of the power train part to the compression mechanism part. Oil lubricating and cooling construction components of each mechanism part is stored at a lower portion of the hermetic case. An oil supplying mechanism pumping and supplying the oil to the construction components of each mechanism part is provided at the rotational shaft.

There are many kinds of oil supplying mechanisms. However, as an example, the oil supplying mechanism includes a hollow portion formed in the rotational shaft, and an oil pumping member inserted into the hollow portion. When the rotational shaft is rotated, the oil pumping member is rotated together so as to pump the oil.

In the oil supplying mechanism, the oil pumping member should be firmly fixed to the rotational shaft so as to be rotated together with the rotational shaft when the rotational shaft is rotated. In addition, a shape of the oil pumping member should not be deformed. If the oil pumping member is not rotated, or a pitch or the like of the oil pumping member is changed when the rotational shaft is rotated, the oil may not be pumped normally.

In order to lubricate a shaft supporting part supporting the rotational shaft, it is necessary to supply the oil to an outer circumferential surface of the rotational shaft which is in contact with the shaft supporting part.

SUMMARY

In an aspect of one or more embodiments, there is provided a compressor having an oil supplying mechanism which may effectively supply oil even when a rotational shaft is rotated at a low number of RPM.

In an aspect of one or more embodiments, there is provided a compressor which includes a rotational shaft, and an oil pumping member inserted into a hollow portion of the rotational shaft so as to be rotated together with the rotational shaft and thus to pump oil, in which the rotational shaft and the oil pumping member are firmly coupled to each other, and the oil pumping member is not deformed when the rotational shaft is rotated, and thus an oil supplying mechanism has improved reliability.

In an aspect of one or more embodiments, there is provided a compressor having an oil supplying mechanism which may effectively lubricate and cool a shaft supporting part supporting a compression mechanism part, a power train part and a rotational shaft.

In an aspect of one or more embodiments, there is provided a compressor which includes a hermetic case to store oil in a lower portion thereof, a compression mechanism part to compress a refrigerant, a power train part to generate a driving force, a rotational shaft to transmit the driving force generated from the power train part to the compression mechanism part and including a hollow portion and a female screw part formed at the hollow portion, and an oil pumping member inserted into the hollow portion of the rotational shaft and including an oil pumping part which moves the oil stored in the lower portion of the hermetic case up and a male screw part which is coupled to the female screw part of the rotational shaft.

The oil pumping member may be a coil spring.

The oil pumping member may be fixed to the rotational shaft and thus rotated together with the rotational shaft.

The male screw part may be formed at one side of the oil pumping member, and the oil pumping part is formed at the other side of the oil pumping member.

The male screw part may have a smaller diameter than the oil pumping part.

The male screw part may have a smaller pitch than the oil pumping part.

The oil pumping part and the male screw part may be formed integrally.

The rotational shaft may be rotated in a clockwise direction, the male screw part and the oil pumping part may be wound in a direction of a right-handed screw, or the rotational shaft may be rotated in a counterclockwise direction, and the male screw part and the oil pumping part may be wound in a direction of a left-handed screw.

The hollow portion may include an upper hollow portion having the female screw part formed thereon, and a lower hollow portion in which the oil pumping part of the oil pumping member is disposed.

The upper hollow portion may have a smaller diameter than the lower hollow portion.

The oil pumping part of the oil pumping member may be in close contact with an inner circumferential surface of the lower hollow portion.

A spiral groove which moves the oil moved up through the hollow portion up may be formed in an outer circumferential surface of the rotational shaft.

The compressor may further include a shaft supporting part which rotatably supports the rotational shaft, and a contact surface between the rotational shaft and the shaft supporting part may be lubricated and cooled by the oil moved up through the spiral groove.

The rotational shaft may be rotated in a clockwise direction, and the spiral groove is formed in a direction of a right-handed screw, or the rotational shaft is rotated in a counterclockwise direction, and the spiral groove is formed in a direction of a left-handed screw.

The compressor may further include a guide rod which is inserted into the oil pumping member so as to guide upward movement of the oil.

The oil pumping member and the guide rod may be spaced apart from each other.

The guide rod may be fixed regardless of rotation of the rotational shaft and the oil pumping member.

The compressor may further include a retainer which is coupled to the guide rod so as to fix the guide rod.

In an aspect of one or more embodiments, there is provided a compressor which includes a hermetic case to store oil in a lower portion thereof, a compression mechanism part to compress a refrigerant, a power train part to generate a driving force, a rotational shaft to transmit the driving force generated from the power train part to the compression mechanism part, and an oil supplying mechanism including an oil pumping member which is coupled into the rotational shaft to fix the oil pumping member to the rotational shaft so as to move the oil stored in the lower portion of the hermetic case up, a spiral groove which is provided in an outer circumferential surface of the rotational shaft so as to further move the oil moved up through the oil pumping member up, and an oil supplying passage which is formed in the rotational shaft so as to supply the oil moved up through the spiral groove to the compression mechanism part and the power train part.

The rotational shaft may have a female screw part, and the oil pumping member has a male screw part which is coupled to the female screw part.

The compressor may further include a shaft supporting part which rotatably supports the rotational shaft, and the spiral groove may be formed adjacent to the shaft supporting part.

The rotational shaft may include an eccentric part which converts a rotational motion into a linear reciprocating motion, and the oil supplying passage has an incline formed at the eccentric part.

In an aspect of one or more embodiments, there is provided a method of manufacturing a compressor which includes a hermetic case, a compression mechanism part, a power train part, a rotational shaft to transmit a driving force of the power train part to the compression mechanism part, and an oil pumping member including a male screw part, which is configured to be inserted into a hollow portion of the rotational shaft so as to move oil stored in a lower portion of the hermetic case in an upward direction, includes forming a female screw part at an upper hollow portion of the hollow portion of the rotational shaft, forming the male screw part configured to be coupled into the female screw part, and coupling the male screw part of the oil pumping member into the female screw part of the rotational shaft, and fixing the oil pumping member to the hollow portion of the rotational shaft.

In the forming of the female screw part, the female screw part may be formed by a tapping process of the hollow portion of the rotational shaft.

The female screw part may be polished through a liquid honing process after the tapping process.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
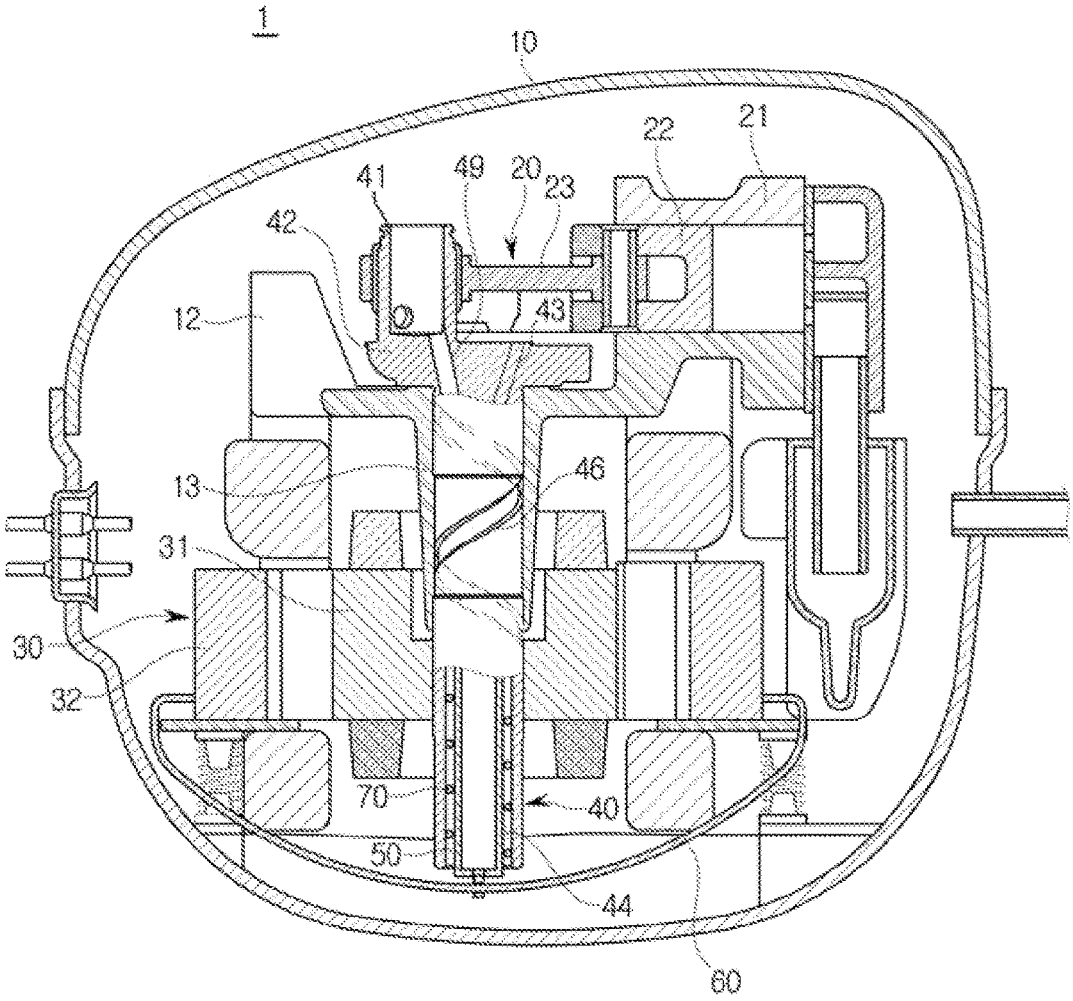
FIG. 1 is a schematic cross-sectional view of a compressor in accordance with an embodiment.

Reference will now be made in detail to embodiments, examples of which are illustrated in the accompanying drawings, wherein like reference numerals refer to like elements throughout.

Figure 2:
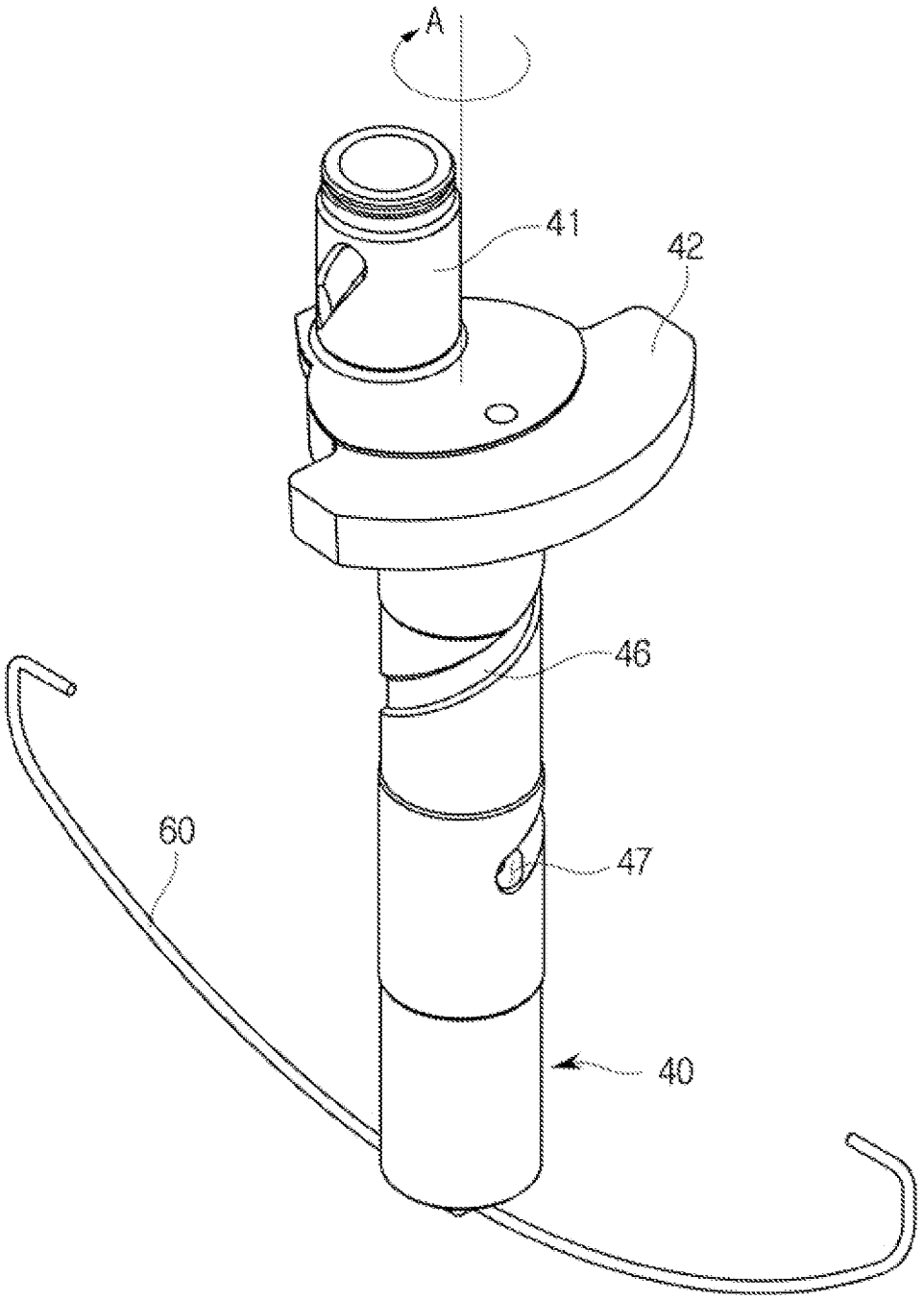
FIG. 2 is a perspective view of a rotational shaft assembly of the compressor of FIG. 1.
Figure 3:
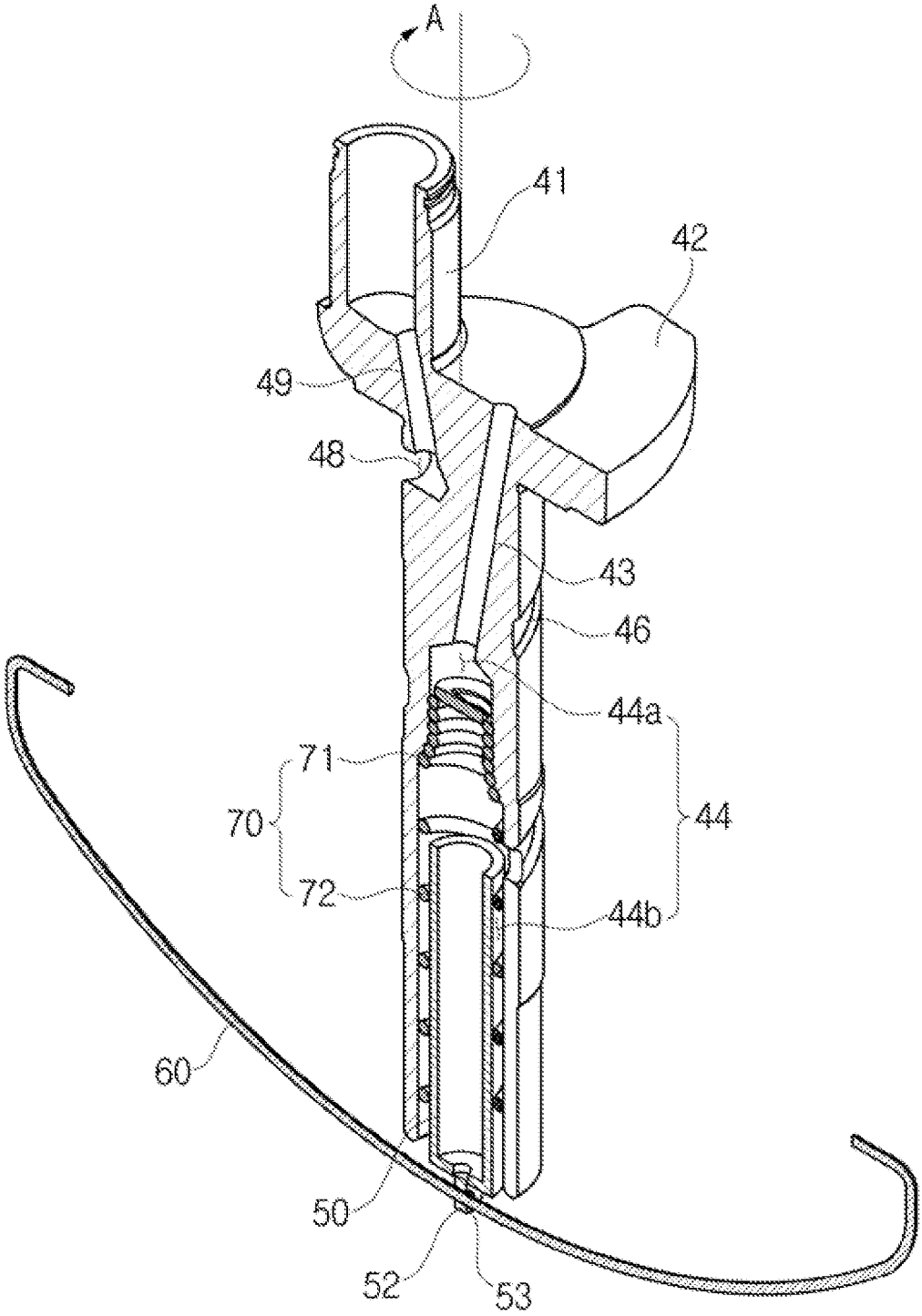
FIG. 3 is a cross-sectional view of the rotational shaft assembly of the compressor of FIG. 1.
Figure 4:
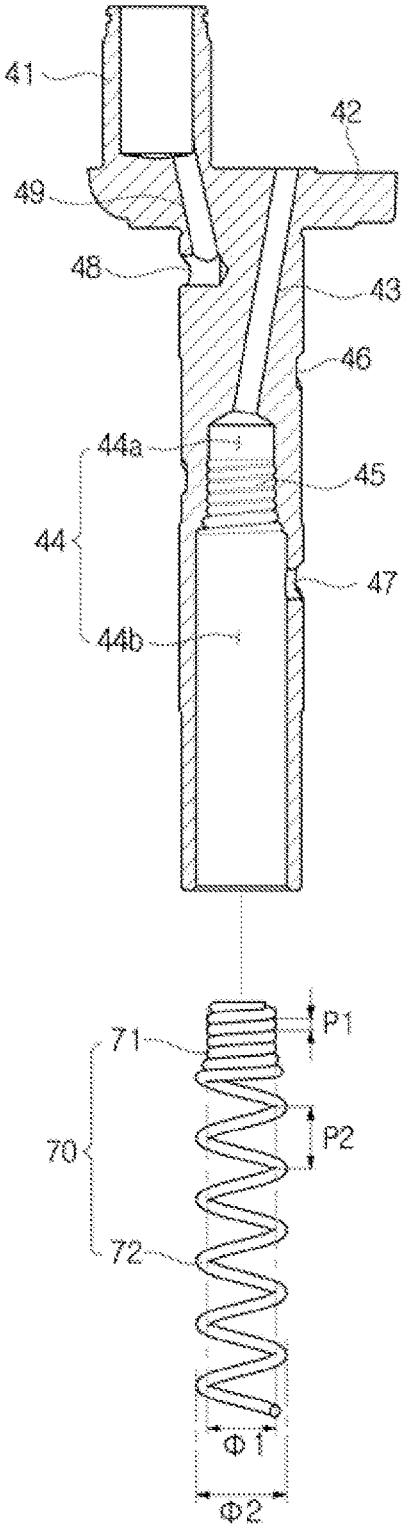
FIG. 4 is a cross-sectional view separately illustrating an oil pumping member and the rotational shaft assembly of the compressor of FIG. 1.
Figure 5:
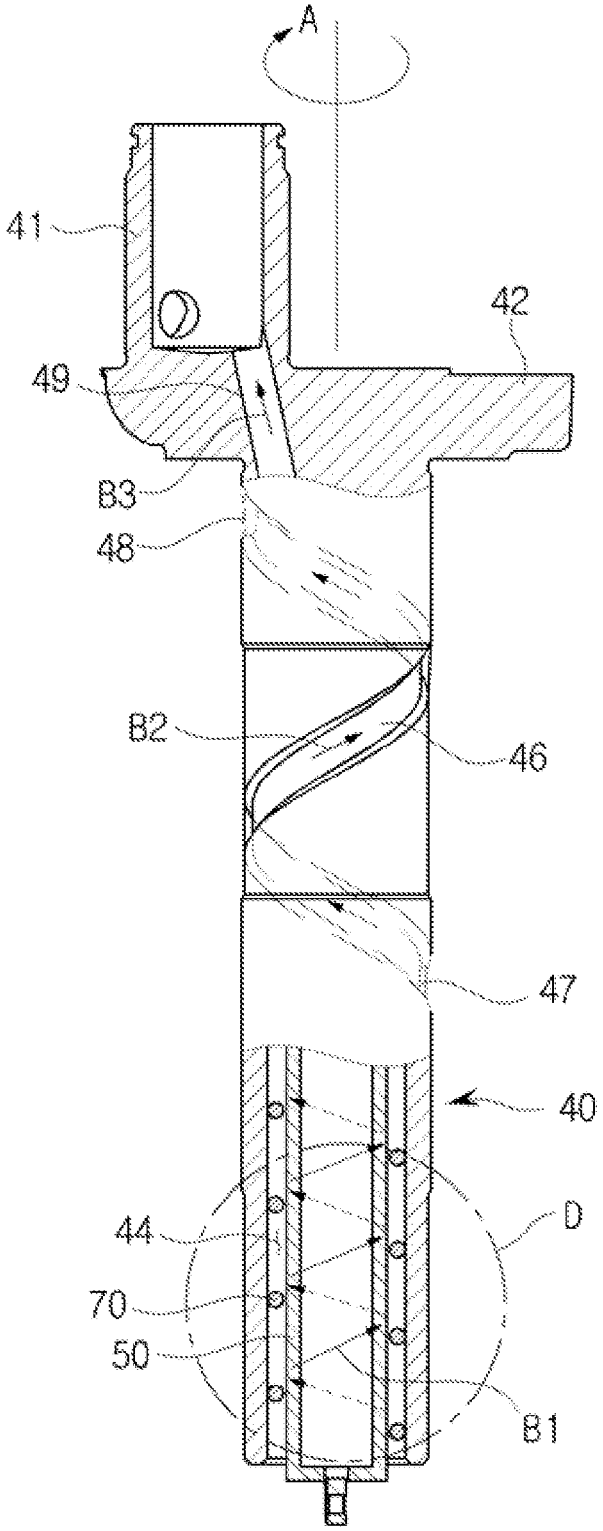
FIG. 5 is a view illustrating an oil supplying operation of the compressor of FIG. 1.
Figure 6:
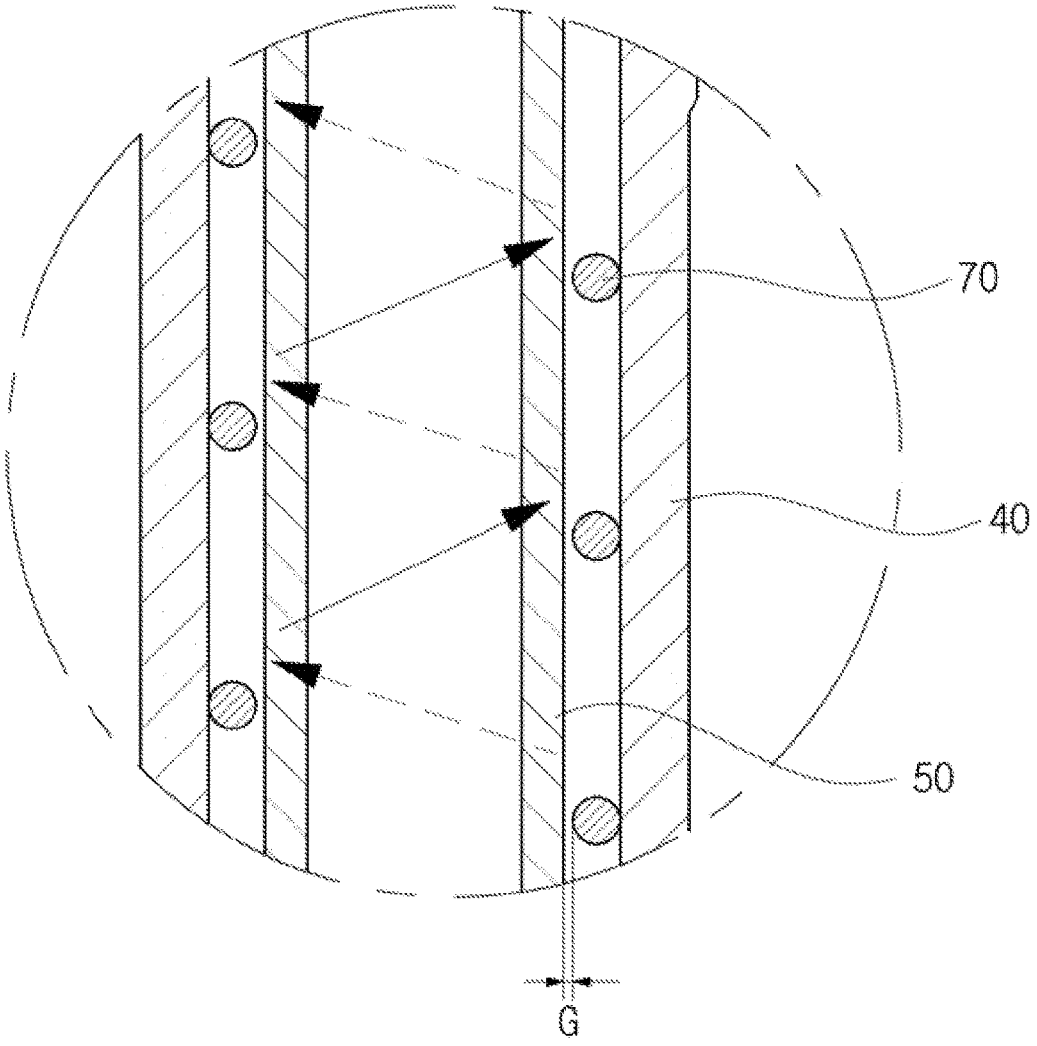
FIG. 6 is a view illustrating a relationship between a guide rod and the oil pumping member of the compressor of FIG. 1, which is an enlarged view of a D portion of FIG. 5.

FIG. 1 is a schematic cross-sectional view of a compressor in accordance with an embodiment, FIG. 2 is a perspective view of a rotational shaft assembly of the compressor of FIG. 1, FIG. 3 is a cross-sectional view of the rotational shaft assembly of the compressor of FIG. 1, FIG. 4 is a cross-sectional view separately illustrating an oil pumping member and the rotational shaft assembly of the compressor of FIG. 1, FIG. 5 is a view illustrating an oil supplying operation of the compressor of FIG. 1, and FIG. 6 is a view illustrating a relationship between a guide rod and the oil pumping member of the compressor of FIG. 1, which is an enlarged view of a D portion of FIG. 5. Here, it should be noted that the rotational shaft assembly includes a rotational shaft 40, an oil pumping member 70, a guide rod 50 and a retainer 60.

Referring to FIGS. 1 to 4 and 6, a compressor 1 in accordance with an embodiment may include a hermetic case 10 forming an exterior thereof, a frame 12 which fixes various construction components in the hermetic case 10, a compression mechanism part 20 which is installed at an upper side of the frame 12 so as to compress a refrigerant, a power train part 30 which is installed at a lower side of the frame 12 so as to drive the compression mechanism part 20, and a rotational shaft 40 which is vertically disposed so as to transmit a driving force generated at the power train part 30 to the compression mechanism part 20 and also rotatably supported by a shaft supporting part 13 of the frame 12.

The compression mechanism part 20 includes a cylinder 21 which forms a compression space of the refrigerant and is fixed to the frame 12, and a piston 22 which is moved forward and backward in the cylinder 21 so as to compress the refrigerant.

The power train part 30 includes a stator 32 which is fixed to the frame 12, and a rotor 31 which is rotated in the stator 32. The rotor 31 includes a hollow which may receive the rotational shaft 40. The rotational shaft 40 is fitted to the hollow of the rotor 31 and also rotated together with the rotor 31 when the rotor 31 is rotated.

An eccentric part 41 which is eccentric from a rotational central axis is formed at an upper portion of the rotational shaft 40, and connected to a piston 22 through a connecting rod 23. Therefore, a rotational motion of the rotational shaft 40 may be converted into a linear reciprocating motion of the piston 22.

A circular plate part 42 extending radially may be formed at a lower portion of the eccentric part 41. A thrust bearing (not shown) which allows the rotational shaft 40 to be smoothly rotated and also supports an axial load of the rotational shaft 40 may be interposed between the circular plate part 42 and the shaft supporting part 13.

Oil which lubricates and cools construction components of the compressor 1 is stored at a lower portion of the hermetic case 10, and this oil is pumped and supplied to each of the construction components by the rotational shaft 40.

The rotational shaft 40 has a hollow portion 44 through which the oil stored at the lower portion of the hermetic case 10 may be pumped. An oil pumping member 70 which is rotated together with the rotational shaft 40 so as to pump the oil stored in the hermetic case 10 is inserted into the hollow portion 44.

The oil pumping member 70 may be a coil spring. However, any spirally wound member may be used instead of a coil spring. When the oil pumping member 70 is rotated together with the rotational shaft 40, the oil may be moved up along an inclined surface of the oil pumping member 70.

Since the oil pumping member 70 should be firmly coupled with the rotational shaft 40, the oil pumping member 70 in accordance with an embodiment may be firmly coupled with the rotational shaft 40, for example, in a screw-coupling manner. The screw-coupling manner refers to the oil pumping member 70 and the rotational shaft 40 themselves are screwed to each other without a separate fastening member.

The oil pumping member 70 has a male screw part 71, and the hollow portion 44 of the rotational shaft 40 has a female screw part 45 (FIG. 4) into which the male screw part 71 of the oil pumping member 70 is screwed.

In addition to the male screw part, the oil pumping member 70 also has an oil pumping part 72 which is in close contact with an inner circumferential surface of the rotational shaft 40 in order to pump the oil. Therefore, the oil pumping member 70 has the male screw part 71 and the oil pumping part 72, the male screw part 71 is provided at one side of the oil pumping member 70, and the oil pumping part 72 is provided at other side thereof.

That is, the male screw part 71 and the oil pumping part 72 are separate parts, and not the same part. However, the male screw part 71 and the oil pumping part 72 may be integrally formed with each other. As an example, the oil pumping member 70 may be formed by machining a part of one coil spring.

Specifically, as illustrated in FIG. 4, a diameter Φ1 of the male screw part 71 may be smaller than a diameter Φ2 of the oil pumping part 72. Further, a pitch P1 of the male screw part 71 may be smaller than a pitch P2 of the oil pumping part 72. That is, the male screw part 71 may be formed by compressing one end of the coil spring in radial and length directions.

A winding direction of the male screw part 71 and a winding direction of the oil pumping part 72 are related with a rotational direction of the rotational shaft 40. Consequently, the winding directions of the male screw part 71 and the oil pumping part 72 are the same.

Specifically, the male screw part 71 of the oil pumping member 70 may be wound in a direction in which the male screw part 71 of the oil pumping member 70 is tightened into the female screw part 45 of the rotational shaft 40 when the rotational shaft 40 is rotated. Therefore, when the rotational shaft 40 is rotated, a coupling force between the rotational shaft 40 and the oil pumping member 70 are not reduced, and thus reliability may be maintained for the long term.

In the embodiment, assuming that the rotational shaft 40 is rotated in a clockwise direction A (FIG. 2) when seen from an upper side, thus the male screw part 71 is provided to be wound in a direction of a right-handed screw.

In such a structure, when the rotational shaft 40 is rotated, the male screw part 71 of the oil pumping member 70 and the female screw part 45 f the rotational shaft 40 are mutually tightened to each other, and thus the coupling force between the oil pumping member 70 and the rotational shaft 40 is not lowered, even when the rotational shaft 40 is rotated.

However, unlike the embodiment, if the rotational shaft 40 has a structure of being rotated in a counterclockwise direction, the oil pumping member 70 should be provided to be wound in a winding direction of a left-handed screw.

The oil pumping part 72 of the oil pumping member 70 should be wound in a direction that the oil is moved up along the inclined surface of the oil pumping part 72, when the rotational shaft 40 is rotated.

As described above, in the embodiment, since the rotational shaft 40 is rotated in the clockwise direction A (FIG. 2) when seen from the upper side, thus the oil pumping part 72 of the oil pumping member 70 is provided to be wound in the direction of the right-handed screw.

By such a structure, the oil may be moved up along the inclined surface of the oil pumping member 70 when the rotational shaft 40 is rotated. However, unlike the embodiment, if the rotational shaft 40 has the structure of being rotated in the counterclockwise direction, the oil pumping member 70 is provided to be wound in the direction of the left-handed screw.

Examining the hollow portion 44 of the rotational shaft 40 in further detail, the hollow portion 44 may include an upper hollow portion 44*a* which has the female screw part 45 (FIG. 4) and in which the male screw part 71 of the oil pumping member 70 is disposed, and a lower hollow portion 44*b* in which the oil pumping part 72 of the oil pumping member 70 is disposed.

As described above, the diameter Φ1 of the male screw part 71 of the oil pumping member 70 is smaller than the diameter Φ2 of the oil pumping part 72, and thus a diameter of the upper hollow portion 44*a* may be provided to be smaller than that of the lower hollow portion 44*b*. The oil pumping part 72 of the oil pumping member 70 is provided to be in close contact with an inner circumferential surface of the lower hollow portion 44*b*.

The female screw part 45 of the rotational shaft 40 may be formed by a tapping process. That is, a tap tool for machining a female screw is inserted into the hollow portion 44 of the rotational shaft 40, and rotated in a proper order so as to form the female screw part 45.

After the tapping process, burrs generated in the tapping process are removed, and the female screw part 45 may be polished through a liquid honing process in order to improve a degree of precision of the female screw part 45.

The liquid honing process is a known process in which a liquid containing abrasive particles is injected into an object at a high speed in order to finish the object.

As described above, since the oil pumping member 70 is firmly fixed to the hollow portion 44 of the rotational shaft 40, for example, in the screw-coupling manner, failure of the oil pumping member 70 to rotate when the rotational shaft 40 is rotated, or variation of the pitch or the like of the oil pumping member 70 when the rotational shaft 40 is rotated is prevented.

As an example, in a conventional structure in which an oil pumping member is fitted to the inner circumferential surface of a hollow portion of a rotational shaft, and the conventional oil pumping member is forced against the conventional rotational shaft by an elastic restoring force, the coupling force (elastic restoring force) between the conventional oil pumping member and conventional rotational shaft is not sufficient. Accordingly, the pitch of the conventional oil pumping member is changed when the conventional rotational shaft is rotated, and thus an oil pumping force may be reduced.

However, since the oil pumping member 70 in accordance with an embodiment is coupled to the rotational shaft 40, for example, in the screw coupling manner, and particularly, the screw coupling is tightened more when the rotational shaft 40 is rotated, an oil pumping mechanism through the oil pumping member 70 has enhanced reliability.

As described above, the oil pumped through the oil pumping member 70 should be guided to an outer circumferential surface of the rotational shaft 40 in order to lubricate and cool the shaft supporting part 13 which rotatably supports the rotational shaft 40.

To this end, the rotational shaft 40 may further include a spiral groove 46 which is provided in the outer circumferential surface of the rotational shaft 40, and a lower connection passage 47 (FIG. 4) which connects the hollow portion 44 of the rotational shaft 40 and the spiral groove 46 provided in the outer circumferential surface. The spiral groove 46 may be formed in the outer circumferential surface which is in contact with the shaft supporting part 13 of the rotational shaft 40. The lower connection passage 47 may connect the spiral groove 46 and the lower hollow portion 44*b* of the rotational shaft 4.

The oil pumped to the hollow portion 44 by the oil pumping member 70 passes through the lower connection passage 47 due to centrifugal force and is guided to the spiral groove 46. The oil guided to the spiral groove 46 may be moved up along the inclined surface of the spiral groove 46. The oil moved up along the spiral groove 46 may lubricate and cool a contact surface between the shaft supporting part 13 and the rotational shaft 40.

The spiral groove 46 has a proper winding direction so as to move the oil up when the rotational shaft 40 is rotated. As described above, in the embodiment, since the rotational shaft 40 is rotated in the clockwise direction when seen from the upper side, the spiral groove 46 is formed to be wound in the direction of the right-handed screw. If the rotational shaft 40 has the structure of being rotated in the counter-clockwise direction, the spiral groove 46 is formed to be wound in the direction of the left-handed screw.

The oil moved up through the spiral groove 46 is guided to the eccentric part 41 of the rotational shaft 40 so as to lubricate and cool the compression mechanism part 20 and the power train part 30.

To this end, the rotational shaft 40 may further include an oil supplying passage 49 which may be inclined in the eccentric part 41, and an upper connection passage 48 which connects the spiral groove 46 formed in the outer circumferential surface of the rotational shaft 40 and the oil supplying passage 49 in the rotational shaft 40.

Further, the rotational shaft 40 may further include an air passage 43 which is connected with the hollow portion 44 so that air in the hollow portion 44 is discharged to an outside. The air passage 43 may properly discharge the air in the hollow portion 44 so as to prevent upward movement of the oil from being stopped by a pressure increase of the hollow portion 44.

The guide rod 50 serving to guide the oil which is moved up by the oil pumping member 70 is inserted into the oil pumping member 70. The guide rod 50 may have a rod shape, and may have a hollow structure like in the embodiment.

That is, the guide rod 50 is inserted in the oil pumping member 70 and thus serves to form a ring-shaped oil pumping space between the guide rod 50 and the inner circumferential surface of the rotational shaft 40.

In the embodiment, the guide rod 50 is fixed to the stator 32 by the retainer 60. However, the guide rod 50 may be fixed to the frame 12 or fixed parts in the hermetic case 10 other than the stator 32. Since the guide rod 50 is fixed as described above, the guide rod 50 is not rotated even when the rotational shaft 40 and the oil pumping member 70 are rotated.

The guide rod 50 may include a protruding portion 52 (FIG. 3) which protrudes downward so that the retainer 60 is coupled thereto. The protruding portion 52 may have a through-hole 53 (FIG. 3) through which the retainer 60 passes and is coupled therein. The retainer 60 may be a wire formed of a metallic material or a resin material.

The guide rod 50 may be provided to be slightly spaced apart from the oil pumping member 70. That is, a predetermined gap G (FIG. 6) may be formed between an outer circumferential surface of the guide rod 50 and the oil pumping member 70. Since the guide rod 50 is disposed to be slightly spaced apart from the oil pumping member 70, resistance may not be generated by the guide rod 50 when the oil pumping member 70 is rotated.

FIG. 5 is a view illustrating an oil supplying operation of the compressor of FIG. 1.

With reference to FIGS. 1 to 5, an oil supplying operation of the compressor in accordance with an embodiment will be described.

If the rotational shaft 40 is rotated, the oil pumping member 70 coupled into the hollow portion 44 of the rotational shaft 40 is also rotated together with the rotational shaft 40. The oil stored in the lower portion of the hermetic case 10 is moved up along the inclined surface of the oil pumping member 70 (B1).

The oil moved up along the inclined surface of the oil pumping member 70 is guided through the lower connection passage 47 to the spiral groove 46 formed in the outer circumferential surface of the rotational shaft 40, and the oil is further moved up along an inclined surface of the spiral groove 46 (B2). The oil moved up along the inclined surface of the spiral groove 46 lubricates and cools the shaft supporting part 13 of the rotational shaft 40.

The oil moved up along the inclined surface of the spiral groove 46 is guided through the upper connection passage 48 to the oil supplying passage 49 of the eccentric part 41, continuously moved up through the oil supplying passage 49, and separated from the rotational shaft 40, thereby lubricating and cooling the compression mechanism part 20 and the power train part 30 (B3).

The compressor in accordance with one or more embodiments may effectively supply the oil even when the rotational shaft is rotated at a low number RPM.

In the compressor in accordance with one or more embodiments, the oil pumping member which is rotated together with the rotational shaft so as to pump the oil is inserted into the rotational shaft. At this time, the oil pumping member is firmly coupled with the rotational shaft, for example, in the screw-coupling manner so as to be prevented from being separated from the rotational shaft or prevented from being deformed when the rotational shaft is rotated, and thus the oil supplying mechanism has improved reliability.

Further, as described above, the oil pumped through the inside of the rotational shaft is pumped again through the spiral groove formed in the outer circumferential surface of the rotational shaft. At this time, the oil pumped through the outer circumferential surface may lubricate and cool the shaft supporting part which rotatably supports the rotational shaft.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A compressor comprising:

a hermetic case to store oil in a lower portion thereof;

a compression mechanism part to compress a refrigerant;

a power train part to generate a driving force;

a rotational shaft which rotates to transmit the driving force generated by the power train part to the compression mechanism part, the rotational shaft comprising an eccentric part coupled to the compression mechanism, a hollow portion including a lower hollow portion, and an upper hollow portion having a smaller diameter than the lower hollow portion, a female screw part formed in the upper hollow portion, and an air passage coupled to the upper hollow portion, above the female screw part, and extending through the rotational shaft to a top surface of the rotational shaft and at an inclination to the top surface of the rotational shaft, to discharge air in the upper hollow portion to an outside of the rotational shaft above the top surface of the rotational shaft; and an oil pumping member inserted into the lower hollow portion and the upper hollow portion, and comprising an oil pumping part disposed in the lower hollow portion, and a male screw part having a smaller diameter than the oil pumping part, and configured so that, when the rotational shaft rotates, the oil pumping part rotates to thereby move upward the oil stored in the lower portion of the hermetic case into the lower hollow portion and the male screw part tightens into the female screw part of the rotational shaft, wherein the rotational shaft further comprises:

a spiral groove formed in the outer circumferential surface of the rotational shaft, a lower connection passage provided below the female screw part and extending through the rotational shaft to connect the lower hollow portion and the spiral groove so that, when the rotational shaft rotates, the oil moved upward into the lower hollow portion by the oil pumping part is guided from the lower hollow portion to the spiral groove and moves upward along the spiral groove, an oil supplying passage extending in the rotational shaft to the eccentric part and being inclined with respect to the eccentric part, and an upper connection passage connecting the spiral groove and the oil supplying passage, wherein the oil supplying passage and the upper connection passage are thereby configured to guide the oil moved upward along the spiral groove, from the spiral groove to the eccentric part so as to lubricate and cool the compression mechanism part.

2. The compressor according to claim 1, wherein the oil pumping member is a coil spring.

3. The compressor according to claim 1, wherein the oil pumping member is fixed to the rotational shaft and thus rotated together with the rotational shaft.

4. The compressor according to claim 1, wherein the male screw part is formed at one side of the oil pumping member, and the oil pumping part is formed at the other side of the oil pumping member.

5. The compressor according to claim 1, wherein the male screw part has a smaller pitch than the oil pumping part.

6. The compressor according to claim 1, wherein the oil pumping part and the male screw part are formed integrally.

7. The compressor according to claim 1, wherein the male screw part and the oil pumping part are configured to be wound in a direction of a right-handed screw, and when the rotational shaft is rotated in a clockwise direction to transmit the driving force, the coupling between the male screw part and the female screw part is tightened, or the male screw part and the oil pumping part are configured to be wound in a direction of a left-handed screw, and when the rotational shaft is rotated in a counterclockwise direction to transmit the driving force, the coupling between the male screw part and the female screw part is tightened.

8. The compressor according to claim 1, wherein the oil pumping part of the oil pumping member is in close contact with an inner circumferential surface of the lower hollow portion.

9. The compressor according to claim 1, further comprising:

a shaft supporting part which rotatably supports the rotational shaft, wherein a contact surface between the rotational shaft and the shaft supporting part is lubricated and cooled by the oil moved up through the spiral groove.

10. The compressor according to claim 1, wherein the rotational shaft is rotated in a clockwise direction, and the spiral groove is formed in a direction of a right-handed screw, or the rotational shaft is rotated in a counterclockwise direction, and the spiral groove is formed in a direction of a left-handed screw.

11. The compressor according to claim 1, further comprising a guide rod which is inserted into the oil pumping member so as to guide upward movement of the oil.

12. The compressor according to claim 11, wherein the oil pumping member and the guide rod are spaced apart from each other.

13. The compressor according to claim 11, wherein the guide rod is fixed regardless of rotation of the rotational shaft and the oil pumping member.

14. The compressor according to claim 13, further comprising a retainer which is coupled to the guide rod so as to fix the guide rod.

* * * * *